US006120331A

United States Patent [19]

Lin

[11] Patent Number: 6,120,331

[45] Date of Patent: Sep. 19, 2000

[54] CONNECTOR ASSEMBLY

[76] Inventor: Ching-Yu Lin, 261, Hua Cheng Road, Hsin Chuang City, Taipei, Taiwan

[21] Appl. No.: 09/413,021

[22] Filed: Oct. 7, 1999

[51] Int. Cl.[7] ..... H01R 13/506

[52] U.S. Cl. ..... 439/686; 439/598

[58] Field of Search ..... 439/686, 598, 439/600, 601, 603, 621, 599, 650, 647

[56] References Cited

U.S. PATENT DOCUMENTS

| | | | |
|---|---|---|---|
| 4,846,723 | 7/1989 | Pong | 439/686 |
| 5,336,114 | 8/1994 | Wang | 439/686 |
| 5,707,255 | 1/1998 | Lu | 439/686 |

*Primary Examiner*—Hien Vu

*Attorney, Agent, or Firm*—Rosenberg, Klein & Lee

[57] ABSTRACT

A connector assembly includes mating plug and socket. The plug includes a unitary insulative casing for receiving a holder retaining first contact blades. A filling material is filled into the casing of the plug for completely shielding and securing the first contact blades. The socket includes a unitary insulative casing for receiving and retaining second contact blades therein. A filling material is filled into the casing of the socket for shielding and securing the second contact blades. The first and second contact blades engage each other when the plug and socket mate with each other for establishing electrical connection therebetween. Filling operation of the filling materials is performed by means of automatized machines thereby enhancing the manufacturing operation thereof.

4 Claims, 5 Drawing Sheets

CONNECTOR ASSEMBLY

FIELD OF THE INVENTION

The present invention generally relates to a connector assembly, and in particular to a connector assembly for use to connect an electrical charging device and an electrical main.

BACKGROUND OF THE INVENTION

There are a lot of devices powered by rechargeable battery sets. A rechargeable battery set requires periodic recharge in order to maintain power level thereof. In charging a rechargeable battery set, the rechargeable battery is connected to an electrical main by means of a releasable connector assembly. An example of a conventional connector assembly for charging purposes is shown in FIG. 1 of the attached drawings. The conventional connector assembly comprises a plug 10 and a socket 20 releasably engageable with each other. The plug 10 and the socket 20 are respectively connected to a rechargeable battery (not shown) and an electrical main (not shown) by means of wires 14, 24 extending therefrom. The socket 20 defines a receiving space 26 into which the plug 10 may be removably inserted whereby the wires 14, 24 are electrically connected to each other for establishing electrical engagement between the plug 10 and the socket 20.

Also referring to FIG. 2, conventionally, both the plug 10 and the socket 20 are two-piece members. The plug 10 comprises a base 11 defining slots 15 therein for receiving conductive contact blades 13 to which the wires 14 are connected and a cover 12 attached to the base 11 by means of for example adhesives or ultrasonic welding to enclose the contact blades 13. Similarly, the socket 20 comprises a base 21 in which the receiving space 26 is defined. Two slits 25 are defined the base 21 of the socket 20 in communication with the cavity 26 for receiving conductive contact blades 23 connected to the wires 24. A cover 22 is attached to the base 21 for housing the contact blades 23 by means of adhesives or ultra-sonic welding.

When the plug 10 is inserted into the receiving space 26 of the socket 20, the contact blades 13 of the plug 10 engage the contact blades 14 of the socket 20 thereby establishing electrical engagement therebetween. Since a great electrical current passing through the contact engagement between the blades 13, 14 during a charging operation, a great amount of heat is generated causing a high temperature which deteriorates materials of the plug 10 and the socket 20, deforms the connector and damages the attachment of the covers 12, 22 to the bases 11, 21. Undesired detachment of the covers 12, 22 from the base 11, 21 may happen leading to separation of the contact blades 35, 44 from the bases 11, 21.

Thus, it is desired to provide a connector assembly for overcoming the above problems.

SUMMARY OF THE INVENTION

Accordingly, an object of the present invention is to provide a connector assembly capable to bearing high temperature during operation thereof without causing damage and deformation.

Another object of the present invention is to provide a connector assembly having a simple structure for facilitating manufacture and reducing costs.

To achieve the above objects, in accordance with the present invention, there is provided a connector assembly comprising mating plug and socket. The plug comprises a unitary insulative casing for receiving a holder retaining first contact blades. A filling material is filled into the casing of the plug for completely shielding and securing the first contact blades. The socket comprises a unitary insulative casing for receiving and retaining second contact blades therein. A filling material is filled into the casing of the socket for shielding and securing the second contact blades. The first and second contact blades engage each other when the plug and socket mate with each other for establishing electrical connection therebetween. Filling operation of the filling materials is performed by means of automatized machines thereby enhancing the manufacturing operation thereof.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
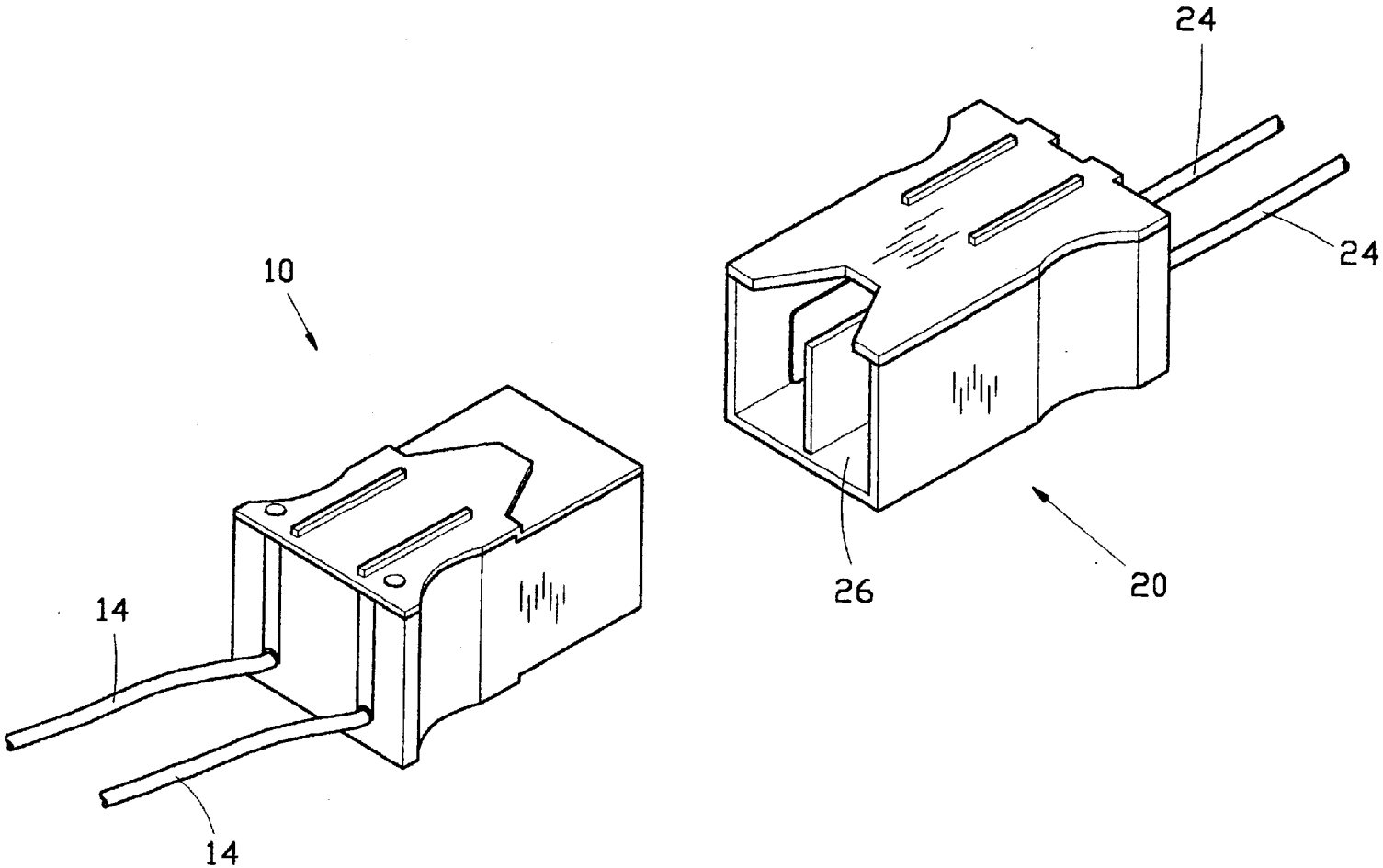
PRIOR ART FIG.1
FIG. 1 is a perspective view of a conventional connector assembly with a plug and a socket thereof detached from each other.
Figure 2:
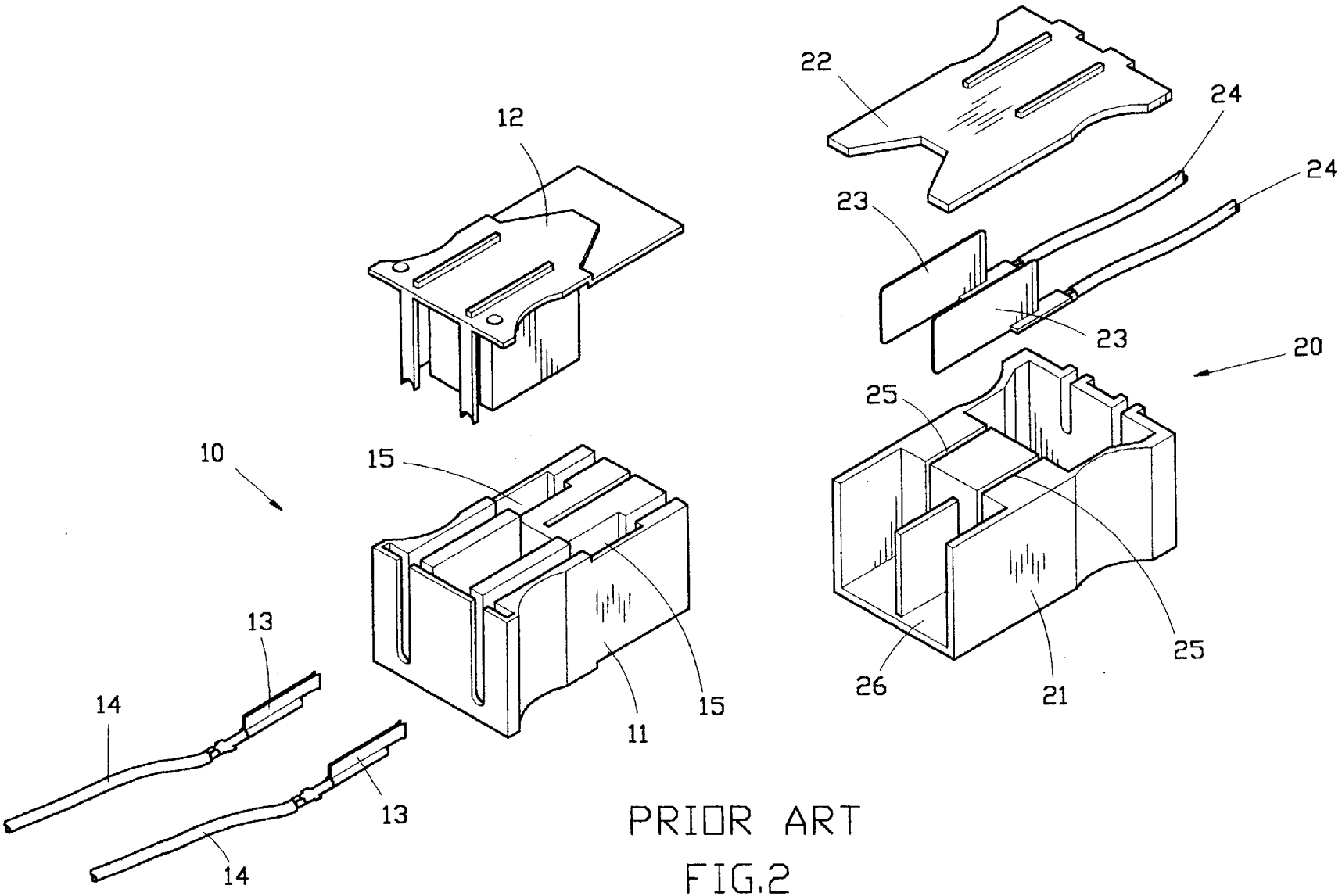
PRIOR ART FIG.2
FIG. 2 is an exploded view of the plug and socket of the conventional connector assembly.
Figure 3:
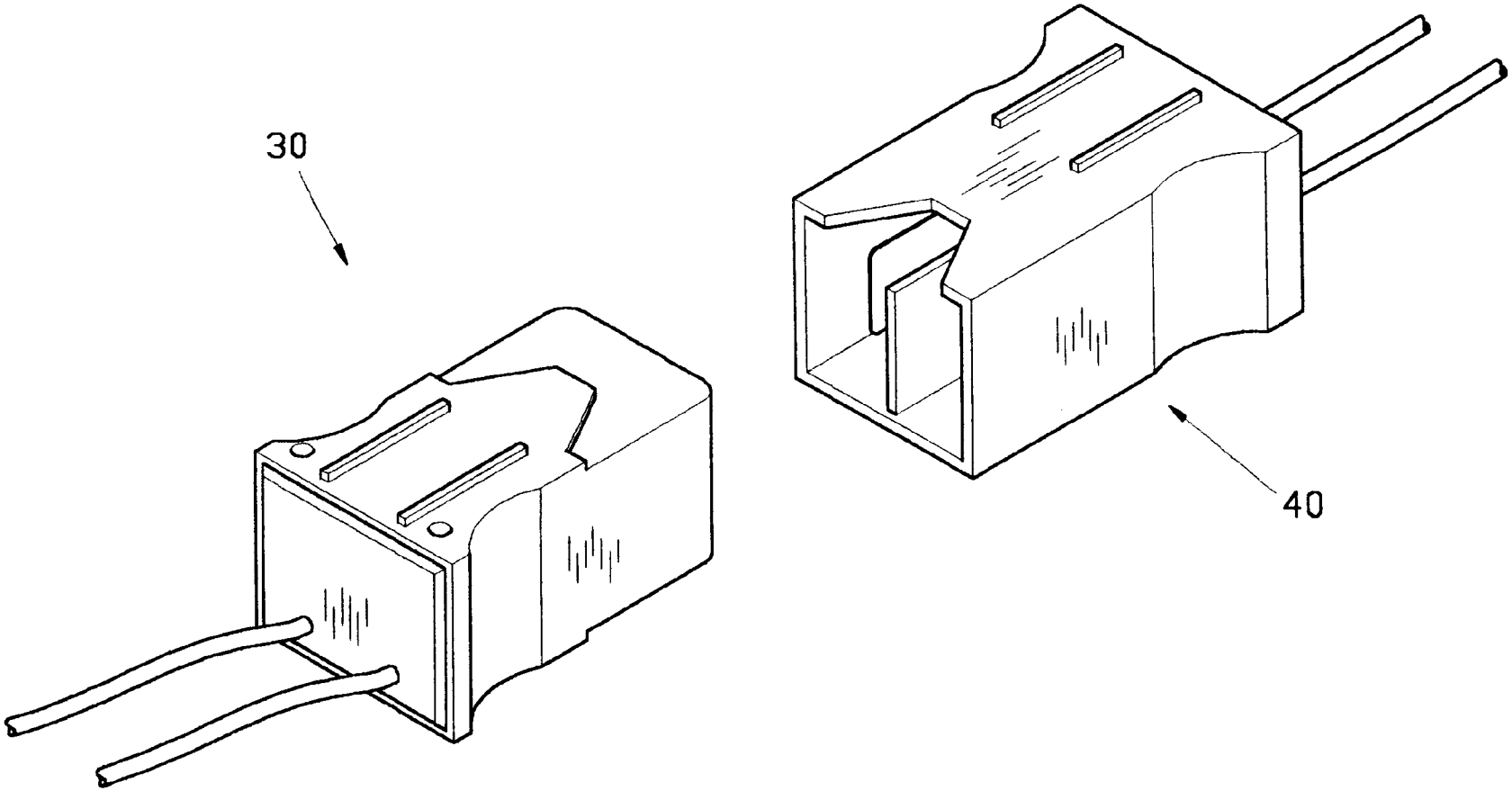
FIG. 3 is a perspective view of a connector assembly constructed in accordance with the present invention with a plug and a socket thereof detached from each other.

With reference to the drawings and in particular to FIG. 3, a connector assembly constructed in accordance with the present invention comprises a plug 30 and a socket 40 mateable with each other for establishing electrical connection therebetween.

Figure 4:
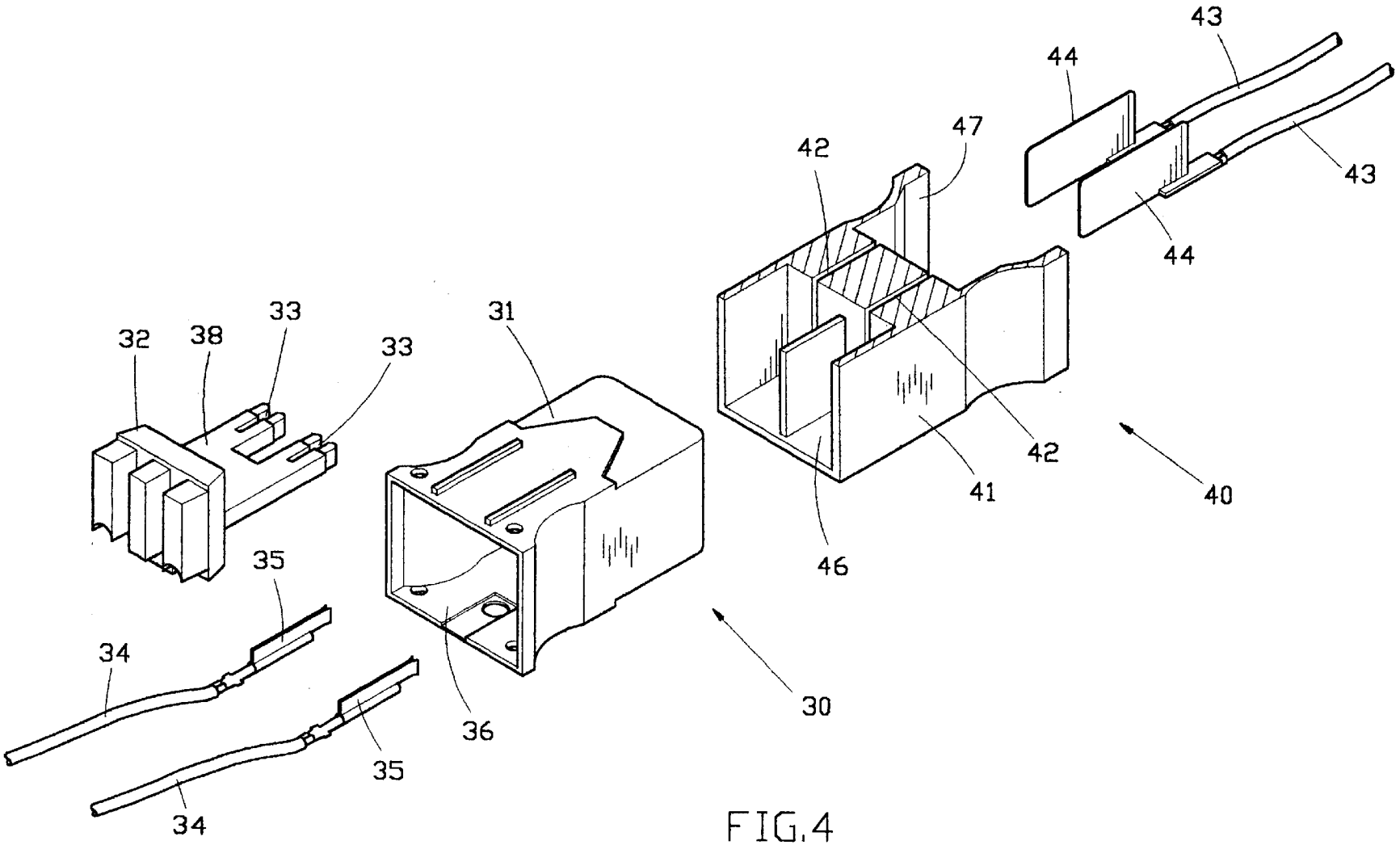
FIG. 4 is an exploded view of the plug and socket of the connector assembly in accordance with the present invention.
Figure 5:
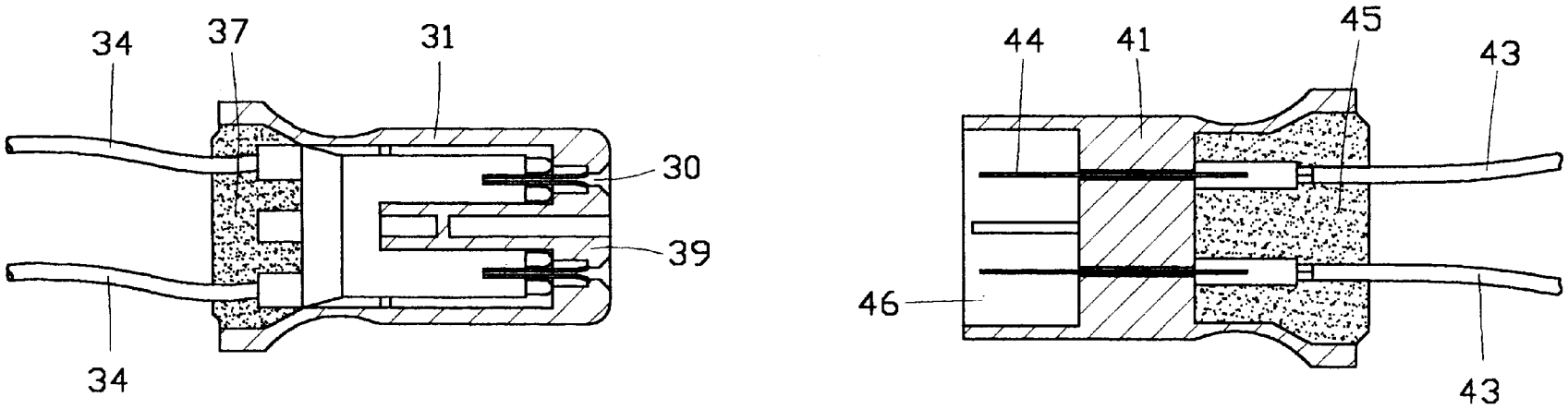
FIG. 5 is a cross-sectional view of the plug and socket of the connector assembly of the present invention.

Also referring to FIG. 4, the plug 30 comprises a tubular, first insulative casing 31 defining an interior space 36 having a rear opening (not labeled) for receiving a contact holder 32. The contact holder 32 is snugly received and retained in the interior space 36 of the first casing 31. The contact holder 32 forms a bifurcated front extension 38 in which two separate slits 33 are defined for receiving and retaining first conductive contact blades 35 therein. First wires 34 are connected to the first contact blades 35 for example by means of soldering or crimping and extend beyond the first casing 31 through the rear opening thereof For securing the contact holder 32 and the first contact blades 35 in the first casing 31, a thermoplastic filling material 37 is filled into the rear opening of the interior space 36 to completely shield and secure the contact holder 32 and the first contact blades 35 as shown in FIG. 5. The first casing 31 has a closed front end 39 in which two slots 30 corresponding to the first contact blades 35 are defined. Preferably, each first contact blade 35 comprises two resilient plates biasingly abutting against each other and substantially aligned with the corresponding slot 30.

Referring back to FIG. 4, the socket 40 comprises a unitary, second insulative casing 41 defining a front opening 46 for receiving the front end 39 of the plug 30 and a rear opening 47. Two slits 42 are defined in the casing 41 communicating between the front and rear openings 46, 47 for partially receiving and retaining two second conductive contact blades 44 to which second wires 43 are connected by means of for example soldering or crimping. The second wires 43 extend beyond the second casing 41 through the rear opening 47 thereof The second contact blades 44 partially extend into the front opening 46 (FIG. 5) whereby when the plug 30 is inserted into the front opening 46, the second contact blades 44 are guided into the slots 30 of the plug 30 and inserted between the plates of the corresponding first contact blades 35 to establish electrical connection therebetween.

Referring to FIG. 5, to secure the second contact blades 44 in the second casing 41, a thermoplastic filling material 45 is filled into the rear opening 47 of the second casing 41 to form a unitary device.

The filling materials 37, 45 may be any suitable insulative, temperature-resistant material, such as soft plastics or silicone rubber, which may be filled into the casings 31, 42 by means of automatized manufacturing apparatus and process and the configurations thereof and the shapes of the plug 30 and the socket 40 may be varied in accordance with actual requirements.

Since the contact blades 35, 44 are securely fixed in the corresponding casings 31, 41 by the filling materials 37, 45, undesired separation of the contact blades 35, 44 from the casings 31, 41 is effectively prevented. Damage and deformation caused by high temperature may thus be substantially reduced. Furthermore, no adhesives or ultra-sonic welding is required in manufacturing the connector assembly thereby effectively reducing the costs and simplifying the manufacturing process thereof.

Although the present invention has been described with respect to the preferred embodiment, it is contemplated that a variety of modifications, variations and substitutions may be done without departing from the scope of the present invention that is intended to be defined by the appended claims.

What is claimed is:

1. An electrical assembly comprising a plug and a socket mateable with each other, the plug comprising:

a unitary first insulative casing defining an interior space having a first rear opening and a closed front end defining two slots;

a contact holder received from the first rear opening and retained in the interior space, the contact holder having a bifurcated front extension extending substantially from a middle portion of said contact holder, said bifurcated front extention having two spaced first slits corresponding to the slots of the closed front end;

two first contact blades received and retained in the first slits of the contact holder with two wires extending therefrom beyond the first casing through the first rear opening; and a first filler filled in the first rear opening to completely shield and secure the contact holder and the first contact blades in the first casing; and the socket comprising:

a unitary second insulative casing defining a front opening for receiving the front end of the plug, a second rear opening and two second slits communicating between the front opening and second rear opening;

two second contact blades partially received and retained in the second slits, two wires extending from the second contact blades and beyond the second casing through the second rear opening, the second contact blades partially extending into the front opening for being inserted into the slots of the front end of the plug to contact the first contact blades when the plug mates with the socket; and a second filler filled in the second rear opening to completely shield and secure the second contact blades in the second casing.

2. The connector assembly as claimed in claim 1, wherein the first and second fillers comprise plastics.

3. The connector assembly as claimed in claim 1, wherein the first and second fillers comprise silicone rubber.

4. The connector assembly as claimed in claim 1, wherein the first and second fillers are filled into the first and second rear openings by means of automatized manufacturing apparatus and wherein the shapes of the plug and the socket may be changed.

* * * * *